US006454318B1

(12) United States Patent
Nozaki et al.

(10) Patent No.: US 6,454,318 B1
(45) Date of Patent: Sep. 24, 2002

(54) STRUCTURE OF A CONNECTION PORTION OF AN EXHAUST PIPE FOR AN ENGINE AND A METHOD FOR PROVIDING THE SAME

(75) Inventors: Naoki Nozaki; Yuichiro Tsuruta; Yasuhiro Matsumoto; Yuji Maki, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/456,406

(22) Filed: Dec. 8, 1999

(30) Foreign Application Priority Data

Dec. 8, 1998 (JP) ..... 10-348059
Oct. 18, 1999 (JP) ..... 11-295422
Nov. 4, 1999 (JP) ..... 11-313555

(51) Int. Cl.[7] ..... F01N 7/08

(52) U.S. Cl. ..... 285/412; 285/420; 285/368; 285/414

(58) Field of Search ..... 285/420, 414, 285/412, 368; 29/890.08, 215, 216

(56) References Cited

U.S. PATENT DOCUMENTS 3,942,141 A * 3/1976 Kaffenberger ..... 333/254
4,281,863 A * 8/1981 Hall ..... 285/382.2
4,541,655 A * 9/1985 Hunter ..... 285/55
4,871,181 A * 10/1989 Usher et al. ..... 277/229
5,374,086 A * 12/1994 Higgins ..... 285/111
5,437,482 A * 8/1995 Curtis ..... 285/174
5,615,867 A * 4/1997 Bauer ..... 267/64.11
5,779,282 A * 7/1998 Ezze ..... 285/261

FOREIGN PATENT DOCUMENTS

JP U-61-88021 6/1986

* cited by examiner

*Primary Examiner*—Robert P. Olszewski
*Assistant Examiner*—James S. McClellan
(74) *Attorney, Agent, or Firm*—Birch, Stewart, Kolasch & Birch, LLP

(57) ABSTRACT

To provide a connection portion of an exhaust pipe for an engine, which is intended to rigidly connect the exhaust pipe to an exhaust port of the engine, to prevent gas leakage by eliminating occurrence of clearance at the connecting portion, to reduce the flow resistance of exhaust gas in the exhaust pipe, and to reduce the production cost of the connection portion. An extension portion extending outwardly is integrally formed on the edge of an end portion of an exhaust pipe; a collar is fixed on the outer periphery of the end portion of the exhaust pipe by caulking; and the edge of the outer end of the collar is abutted against the extension portion.

12 Claims, 6 Drawing Sheets

STRUCTURE OF A CONNECTION PORTION OF AN EXHAUST PIPE FOR AN ENGINE AND A METHOD FOR PROVIDING THE SAME

BACKGROUND OF THE INVENTION

1. Field of the Invention

The present invention relates to a structure of a connection portion of an exhaust pipe, where the connection portion is connected to an exhaust port of an engine, typically, an engine for a motorcycle.

2. Background Art

An example of a connection portion of an exhaust pipe, where the connection portion is connected to an exhaust port of an engine is disclosed in Japanese Patent Utility Model Laid open No. Sho 61 8802 1.

The above described related art structure is configured such that a collar is fitted to the outer periphery of an end portion of the exhaust pipe, and the inner peripheral surface of the collar is fixed to the edge of an end portion of the exhaust pipe by welding; and the exhaust pipe is connected to the exhaust port via the collar by means of bolts.

The above described related art structure, however, has the following problems:

(1) Since the exhaust pipe is connected to an exhaust port via the collar by means of bolts, stress concentration may occur at a welding portion between the exhaust pipe and the collar, thereby reducing the strength of the connection portion;

(2) a clearance between the exhaust pipe and the collar may become larger due to looseness therebetween and the like, thereby causing gas leakage due to occurrence of cracks or the like; and (3) the welding control for preventing a reduction in flow resistance of exhaust gas flowing in the exhaust pipe due to welding beads formed on welding between the exhaust pipe and the collar is complicated.

SUMMARY OF THE INVENTION

In view of the foregoing, the present invention has been made to solve these problems of the related art, and to improve the overall state of the art.

An object of the present invention is to provide a new structure of a connection portion of an exhaust pipe for an engine.

To achieve the above object, there is provided a connection portion of an exhaust pipe, where the connection portion is connectable to an exhaust port side of an engine, the connection portion includes an extension portion extending radially outwardly and integrally formed on an edge of an end portion of the exhaust pipe; and a collar fixed to an outer periphery of the end portion of said exhaust pipe by crimping, wherein the edge of an end portion of said collar is abutted against said extension portion. With this configuration, the exhaust pipe can be rigidly connected to the exhaust port without occurrence of stress concentration therebetween; a clearance between the exhaust pipe and the collar is made as small as possible; since there is no welding bead appeared in the related art structure of a connection portion of an exhaust pipe, the flow resistance of exhaust gas is not increased, and therefore, it is not required to perform mechanical treatment for reducing the flow resistance of exhaust gas; and since the welding means is not required, it is possible to significantly reduce the cost.

In addition, to achieve the above object, there is provided a connection portion of an exhaust pipe, where the connection portion is connectable to an exhaust port side of an engine, the connection portion includes a reinforcing outer pipe fixed on an outer periphery of an end portion of the exhaust pipe by crimping; and a collar fixed on an outer periphery of said outer pipe. With this configuration, the reinforcing outer pipe can be rigidly fixed to the exhaust pipe without welding, to significantly increase the strength of the connection portion of the exhaust pipe, and also a clearance between the exhaust pipe and the outer pipe is made as small as possible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

First, a first embodiment of the present invention will be described with reference to FIGS. 1 to 5.

Figure 1:
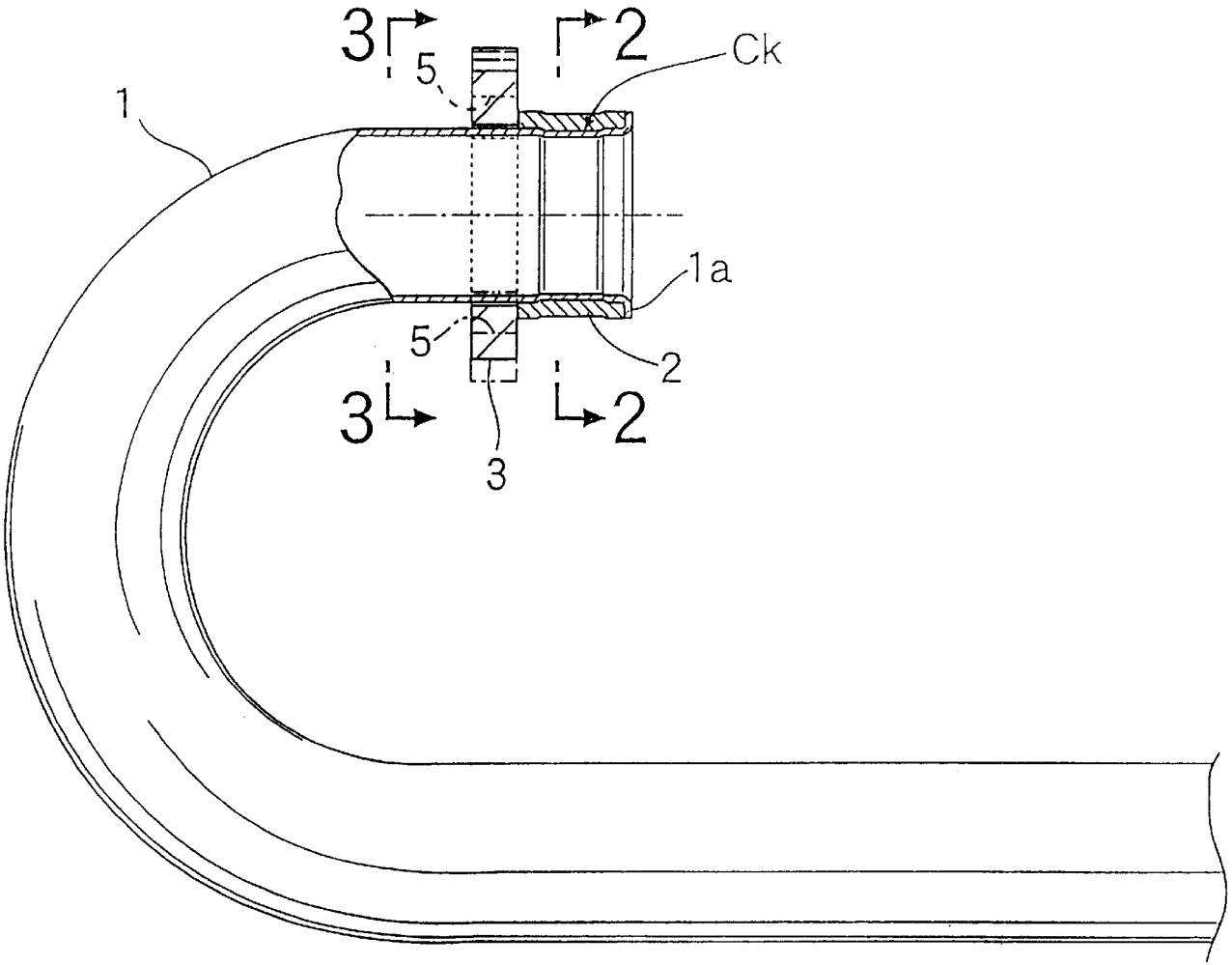
FIG. 1 is a side view, with a portion broken away, of an exhaust pipe including a connection portion structure of the present invention (first embodiment)
Figure 2:
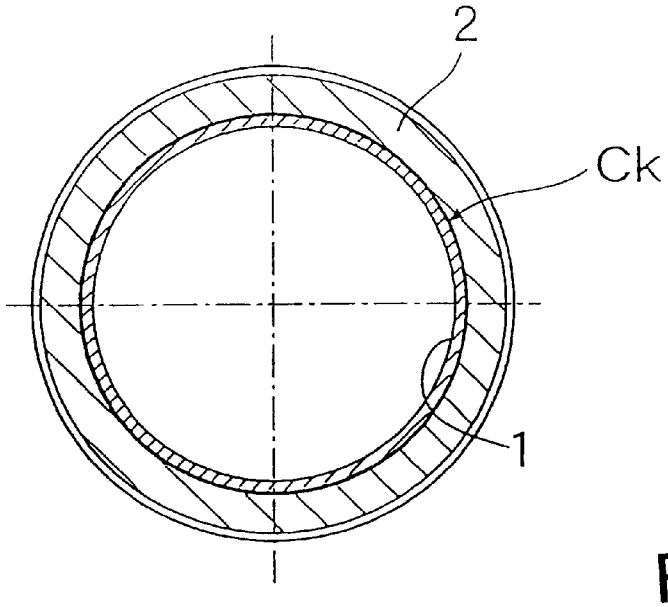
FIG. 2 is a sectional view taken on line 2—2 of FIG. 1 (first embodiment)
Figure 3:
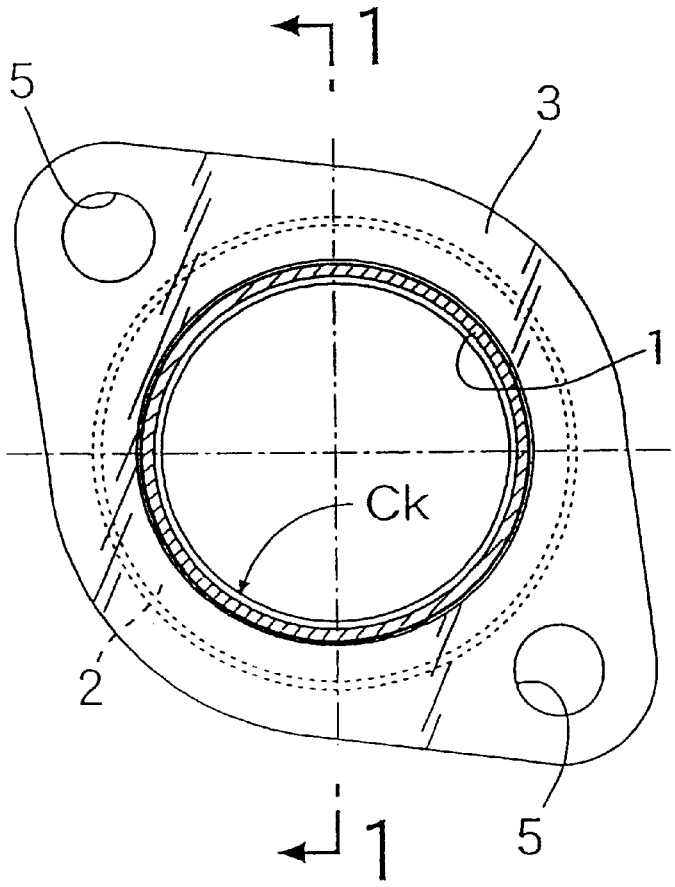
FIG. 3 is a sectional view taken on line 3—3 of FIG. 1 (first embodiment)
Figure 4A:
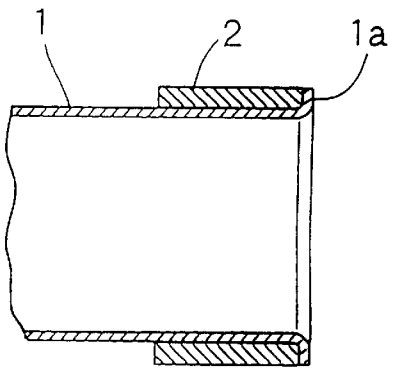
FIGS. 4(*a*) to 4(*c*) are sectional views showing a process of fixing a collar to an exhaust pipe by crimping (first embodiment)
Figure 4B:
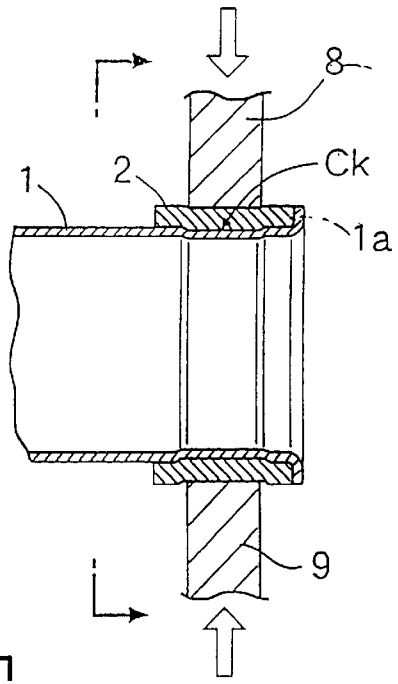
Figure 4C:
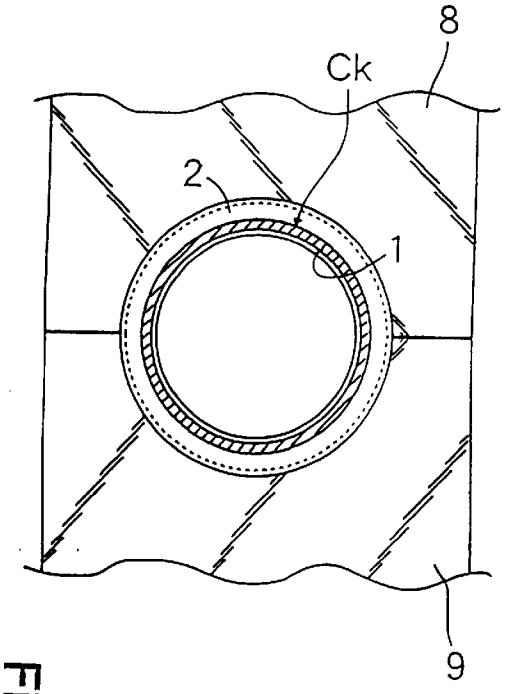
Figure 5:
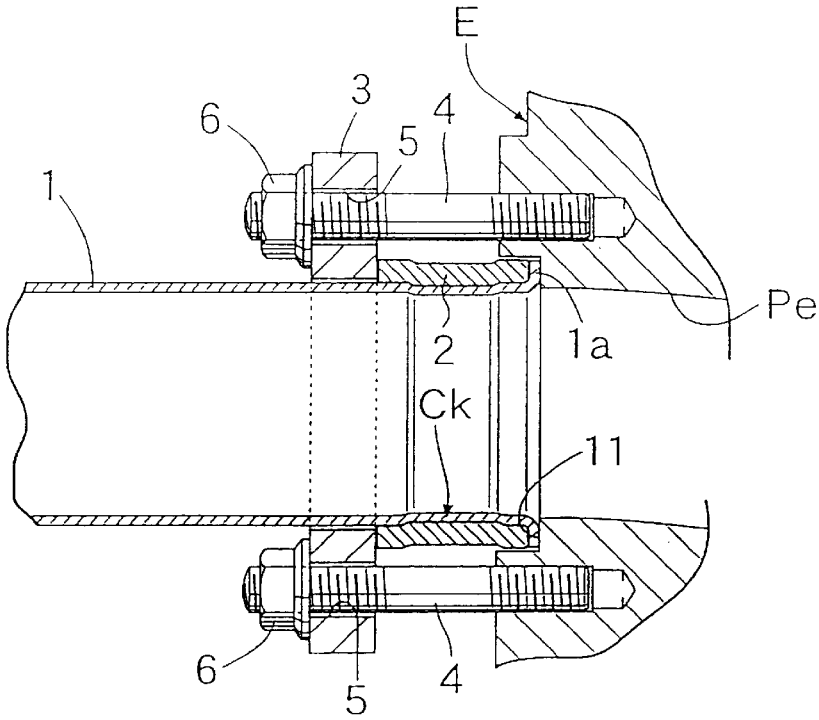
FIG. 5 is a sectional view showing a state in which the exhaust pipe is assembled in an engine (first embodiment)

FIG. 1 is a side view, with a portion broken away taken on line 1—1 of FIG. 3, showing an exhaust pipe including a connection portion structure of the present invention; FIG. 2 is a sectional view taken on line 2—2 of FIG. 1; FIG. 3 is a sectional view taken on line 3—3 of FIG. 1; FIGS. 4(*a*) to 4(*c*) are sectional views showing a process of fixing a collar to an exhaust pipe by crimping; and FIG. 5 is a sectional view showing a state in which the exhaust pipe is assembled in an engine.

Referring to FIGS. 1 to 3, a flange like extension portion 1*a* projecting radially outwardly is integrally formed on the edge of a connection side end portion, to be connected to an exhaust port Pe of an engine E (see FIGS. 5, 8 & 9), of a stainless steel made cylindrical exhaust pipe 1. The base end of the extension portion 1*a* is formed into a rounded plane.

A carbon steel short sized cylindrical collar 2 is rigidly fixed, by a crimp Ck, on the outer periphery of a connection side end portion, to be connected to the exhaust pipe Pe of the engine E, of the exhaust pipe 1 by means of a crimping means to be described later. The edge of the outer end of the collar 2 abuts against the inner end surface of the extension portion 1*a*.

A carbon steel rhombic joint 3 is slidably fitted on the outer periphery of the end portion of the exhaust pipe 1 at a position offset inwardly from the collar 2. One end surface of the joint 3 is abutted against the inner end surface of the collar 2. The joint 3 is used for connecting the exhaust pipe 1 to the opening end of the exhaust port Pe of the engine E in co-operation with stud bolts 4 (see FIGS. 5, 8 & 9) planted by screwing in the surface portion of the opening end of the exhaust port Pe of the engine E. A pair of bolt holes 5 for allowing the stud bolts 4 to pass therethrough are provided in the outer end portion, opposed to the opening end of the exhaust port Pe, of the joint 3.

Referring to FIGS. 4(*a*) to 4(*c*), a process of fixing the collar 2 to the end portion of the exhaust pipe 1 by crimping is shown. The entire outer periphery of the collar 2 is crimped from outside to the outer periphery of the exhaust pipe 1. As shown in FIG. 4(*a*), the collar 2 is set on the outer periphery of the end portion of the exhaust pipe 1, and the edge of the outer end of the collar 2 is abutted against the extension portion 1*a* at the edge of the end portion of the exhaust pipe 1. Then, as shown in FIGS. 4(*b*) and 4(*c*), a portion of the collar 2 is crimped in the vertical direction by the crimping means, wherein shown as upper and lower crimping dies 8 and 9, with a result that the outer peripheries of the exhaust pipe 1 and the portion of the collar 2 are crimped together to be integrated with each other. The collar 2 is thus rigidly fixed to the exhaust pipe 1 by the crimp Ck. It is readily obvious to those of ordinary skill in the art that the crimping means is not limited to the upper and lower crimping dies 8 and 9. For example, the crimping means may be dies operable to crimp collar at locations around the periphery thereof, not along the entire periphery as shown. Moreover, the position of the dies 8 and 9 are not limited to the width or style shown. Furthermore, the dies 8 and 9 are not limited to the width and position shown in the Figures.

The structure of mounting the exhaust pipe 1, on which the collar 2 has been fixed by the crimp Ck as described above, to the exhaust port Pe of the engine E will be described below with reference to FIG. 5. An annular fitting groove 11 is formed in the opening end portion of the exhaust port Pe. The end portion of the exhaust pipe 1, on which the collar 2 has been fixed by crimping, is fitted in the fitting groove 11. Two stud bolts 4 are planted by screwing in the opening end portion of the exhaust port Pe. The exhaust pipe 1 is set to the exhaust port Pe such that the two stud bolts 4 are allowed to pass through the bolt holes 5 and fastened with nuts 6, to thus rigidly hold the collar 2 together with the extension portion 1*a* of the exhaust pipe 1 between the end surface of the exhaust port Pe and the joint 3. In this way, the exhaust pipe 1 can be integrally connected to the exhaust port Pe of the engine E.

According to the connection portion structure of the exhaust pipe 1 in the first embodiment, it is possible to rigidly connect the exhaust pipe 1 to the exhaust port Pe without occurrence of any stress concentration therebetween, and to make a clearance between the exhaust pipe 1 and the collar 2 as small as possible. Also since welding beads which appeared in the above described related art structure are not present, the flow resistance of exhaust gas is not increased, and thereby it is not required to perform mechanical treatment for reducing the flow resistance of exhaust gas. Further, since the welding means is not required to implement the present invention, it is possible to significantly reduce the cost of the exhaust structure and the manufacturing cost thereof A second embodiment of the present invention will be described below with reference to FIGS. 6 to 8.

Figure 6:
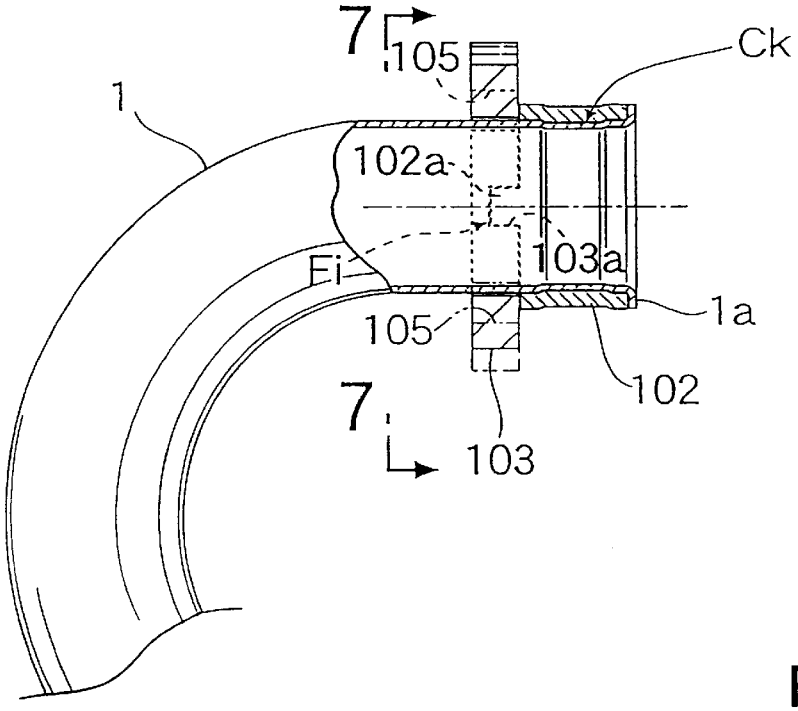
FIG. 6 is a side view, with a portion broken away taken along line 6—6 of FIG. 7, showing an exhaust pipe including a connection device of the present invention (second embodiment)
Figure 7:
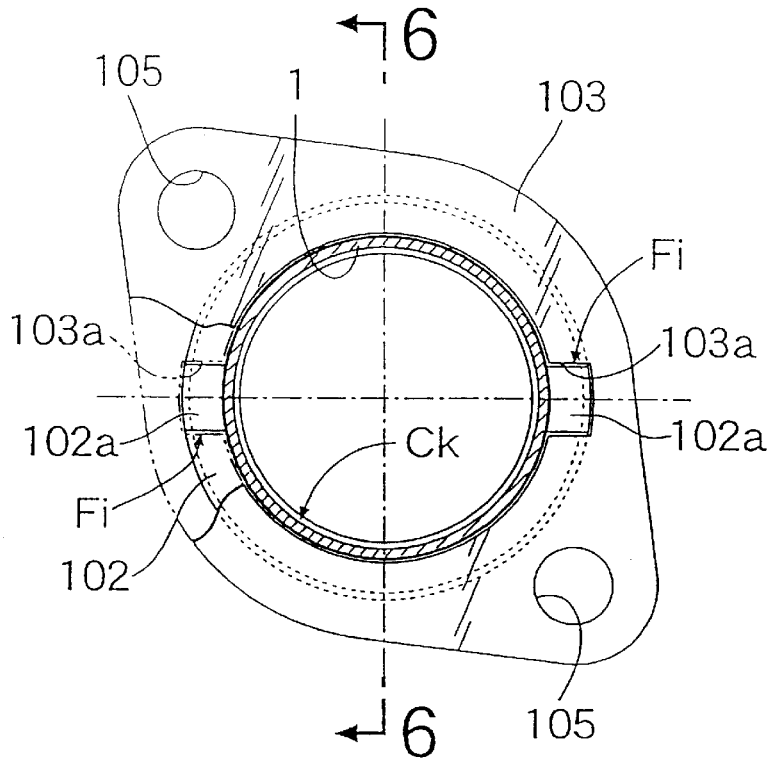
FIG. 7 is a sectional view taken on line 7—7 of FIG. 6 (second embodiment)
Figure 8:
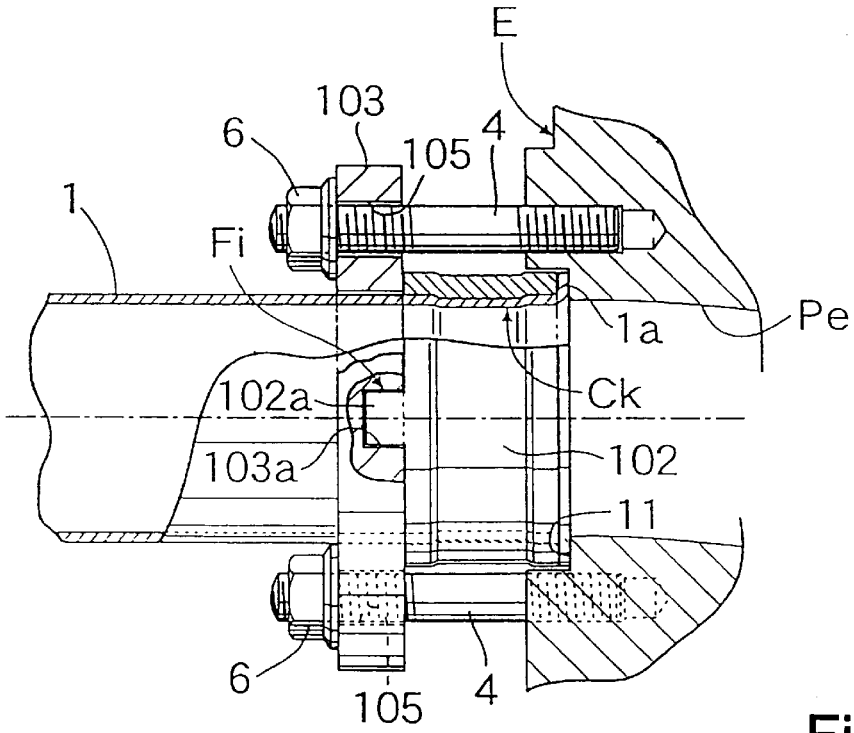
FIG. 8 is a sectional view showing a state in which the exhaust pipe is assembled in the engine (second embodiment)

FIG. 6 is a side view, with an essential portion broken away taken along line 6—6 of FIG. 7, showing an exhaust pipe including a connection device of the present invention; FIG. 7 is a sectional view taken on line 7—7 of FIG. 6; and FIG. 8 is a sectional view showing a state in which the exhaust pipe is assembled in an engine. In these figures, parts corresponding to those in the first embodiment are designated by the same characters.

In the second embodiment, a positioning means Fi is provided between a collar 102, fixed at an end portion of the exhaust pipe 1 by crimping, and a joint 103 fitted to the exhaust pipe 1. A pair of positioning projections 102*a*, spaced at a phase difference of approximately 180°, are formed on the inner end surface, to be abutted against the joint 103, of the cylindrical collar 102 in such a manner as to project therefrom in the axial direction. Meanwhile, a pair of positioning recessed grooves 103*a* corresponding to the pair of positioning projections 102*a*, which are similarly spaced at a phase difference of approximately 180°, are formed on the inner peripheral surface of the joint 103 formed into a rhombic shape and having a pair of bolt holes 105 in such a manner as to be each located at an intermediate portion between the pair of bolt holes 105. The projections 102*a* and the recessed grooves 103*a* constitute the positioning means Fi. It is readily apparent to those of ordinary skill in the art that the positioning means Fi is not limited to the projection pairs 102*a* and the recessed grooves 103*a*. For example , the positioning means Fi may be any means capable of aligning the exhaust pipe 1 with the exhaust port Pe.

Like the first embodiment, the collar 102 is fixed using a crimp Ck on the outer periphery of the end portion, on the connection side to the exhaust pipe Pe, of the exhaust pipe 1, and the joint 103 is slidably fitted on the outer periphery of the end portion, positioned inwardly from the collar 102, of the exhaust pipe 1. The inner end surface of the collar 102 is abutted against one end surface of the joint 103. At this time, the peripheral positioning between the collar 102 and the joint 103 is performed by fitting the pair of projections 102*a* of the collar 102 in the pair of the recessed grooves 103*a* of the joint 103.

The pair of bolt holes 105 of the joint 103 are allowed to pass through the stud bolts 4 planted by screwing in an opening end surface of the exhaust port Pe, and the stud bolts 4 are screwed with nuts 6. In this way, the collar 102 is forcibly held between the end surface of the exhaust port Pe and the joint 103, so that the exhaust pipe 1 is integrally connected to the exhaust port Pe.

According to the second embodiment, in addition to the same function and effect as those of the first embodiment, the peripheral positioning between the collar 102 and the joint 103 can be simply performed by the positioning means Fi, with a result that the exhaust pipe 1 is easily connected to the exhaust port Pe.

A third embodiment of the present invention will be described with reference to FIG. 9.

Figure 9:
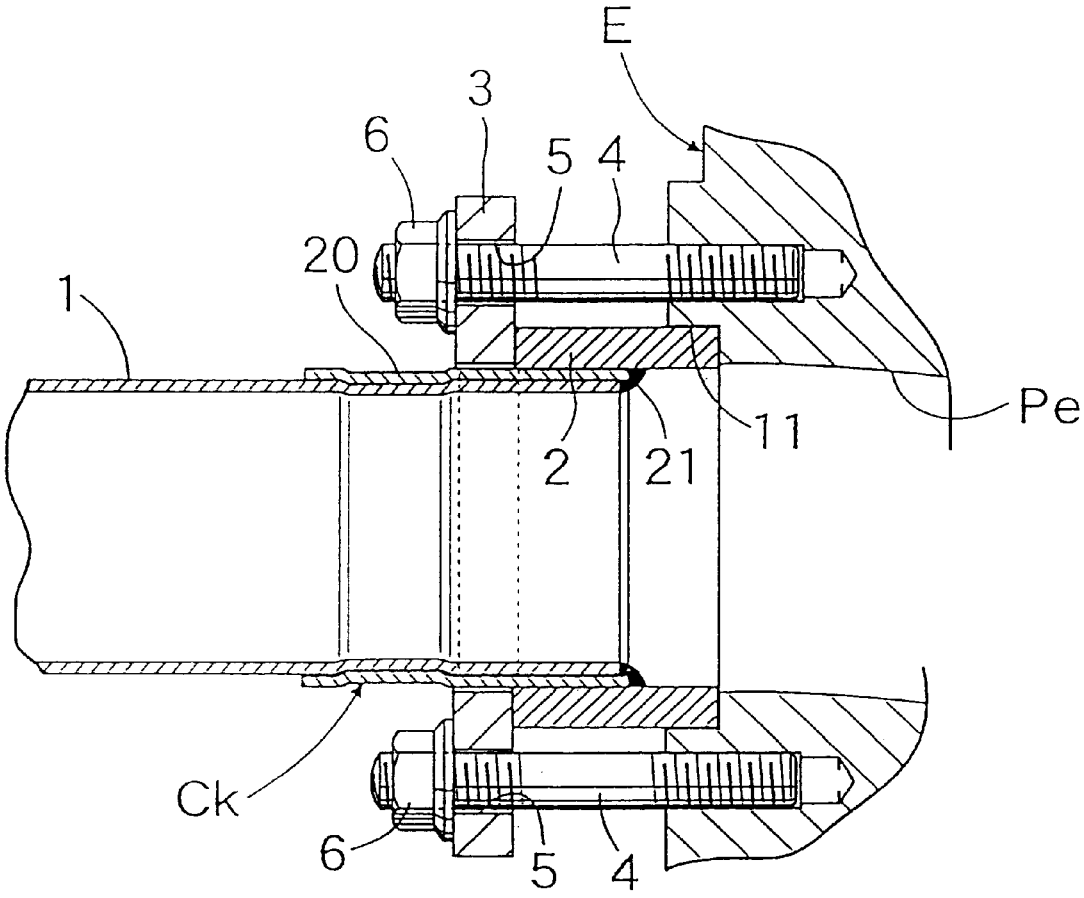
FIG. 9 is a sectional view showing a state in which an exhaust pipe in the engine (third embodiment).

FIG. 9 is a sectional view showing a state in which an exhaust pipe is assembled in the engine. In the Figure, parts corresponding to those described in the first and second embodiments are designated by the same characters.

The third embodiment is characterized by additionally providing a reinforcing outer pipe 20 on the exhaust pipe 1. A cylindrical outer pipe 20 having a specific length is fitted on a connection side end portion, to be connected to the exhaust port Pe side of the engine E, of the exhaust pipe 1. A collar 2 is fitted on the outer periphery of the outer pipe 20. The inner peripheral surface of the collar 2 is fixed to both of the edges of the end portions of the exhaust pipe 1 and the outer pipe 20 by a fixing means 21 such as welding. Alternatively, the fixing means may be bonding using an epoxy, or the collar 2 and the reinforcing outer pipe 20 may be formed integrally together.

A portion, positioned inwardly from the collar 2, of the outer pipe 20 is fixed, using a crimp Ck, on the exhaust pipe 1. To be more specific, like the first embodiment, the entire periphery of the outer pipe 20 is crimped on the entire periphery of a portion of the exhaust pipe 1 in the vertical direction by means dies 8 and 9. Therefore, the entire peripheries of the outer pipe 20 and the portion the exhaust pipe 1 are crimped together. In this way, the outer pipe 20 is fixed on the exhaust pipe 1 by crimping.

The joint 3 is slidably fitted on the outer periphery of the outer pipe 20, and one end of the joint 3 is abutted against the inner surface of the collar 2.

Like the first embodiment, the exhaust pipe 1 is integrally connected to the opening end of the exhaust port Pe by means of stud bolts 4 and nuts 6 while holding the collar 2 between the opening end of the exhaust port Pe and the joint 3.

In the second embodiment, since the reinforcing outer pipe 20 can be rigidly fixed to the exhaust pipe 1 without use of welding, that is, by crimping, it is possible to significantly increase the strength of the connection portion of the exhaust pipe 1, and to make a clearance between the exhaust pipe 1 and the outer pipe 20 as small as possible.

While the first, second and third embodiments of the present invention have been described, such description is for illustrative purpose only, and it is to be understood that many variations may be made without departing from the scope of the present invention. For example, although the entire periphery of the collar or the outer pipe is crimped to the exhaust pipe in the above described embodiments, part of the collar or the outer pipe may be crimped to the exhaust pipe as an alternative.

While the collar or outer pipe is crimped from outside to the exhaust pipe in the above described embodiments, the exhaust pipe may be crimped from inside, that is, from the inner side of the exhaust pipe, to the collar or the outer pipe.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A connection portion of an exhaust pipe, where the connection portion is connectable to an exhaust port side of an engine, the connection portion comprising:

an end portion of an exhaust pipe connectable to the exhaust port side of the engine, said end portion of the exhaust pipe having an outer surface and an inner surface;

an extension portion extending radially outwardly and integrally formed on an edge of the end portion of the exhaust pipe, said extension portion having an inner end surface and an outer end surface; and a collar fixed to the outer surface of the end portion of said exhaust pipe, said collar having a collar inner surface, an end portion with an edge, and a collar outer surface, wherein the edge of the end portion of said collar is abutted against the inner surface of said extension portion, and at least one of said inner surface and said outer surface of said end portion being integrally secured and crimped together with at least one of said collar inner surface or said collar outer surface.

2. The connection portion of claim 1, further comprising a joint slidably fitted on the exhaust pipe at a position offset inwardly from said collar.

3. The connection portion of claim 2, wherein said joint comprises at least one bolt hole disposed therethrough for fastening the exhaust pipe to the exhaust port side of the engine.

4. The connection portion of claim 1, further comprising positioning means for assuredly positioning the exhaust pipe with the exhaust port side of the engine.

5. The connection portion of claim 4, wherein said positioning means comprises a pair of positioning projections formed on an inner end surface of said collar in such a manner as to project therefrom in an axial direction, and a pair of positioning recessed groves formed on an inner peripheral surface of said joint, wherein when said collar abuts against said joint, said pair of positioning projections and said pair of positioning recessed groves align.

6. The connection portion of claim 5, wherein each of said pair of positioning projections is spaced at a phase difference of approximately 180° from each other, and each of said pair of positioning recessed groves is spaced at a phase difference of approximately 180° from each other.

7. The connection portion of claim 1, wherein said collar outer surface is crimped to said outer surface of said end portion of the exhaust pipe.

8. The connection portion of claim 1, wherein said collar inner surface is crimped to said outer and inner surface of said end portion of the exhaust pipe.

9. The connection portion of claim 1, wherein said end portion of said exhaust pipe being stainless steel and said collar being carbon steel.

10. The connection portion of claim 3, wherein said collar outer surface is crimped to said outer surface of said end portion of the exhaust pipe.

11. The connection portion of claim 3, wherein said collar inner surface is crimped to said outer and inner surface of said end portion of the exhaust pipe.

12. The connection portion of claim 3, wherein said end portion of said exhaust pipe being stainless steel and said collar being carbon steel.

* * * * *

UNITED STATES PATENT AND TRADEMARK OFFICE

CERTIFICATE OF CORRECTION

PATENT NO. : 6,454,318 B1
DATED : September 24, 2002
INVENTOR(S) : Naoki Nozaki et al.

It is certified that error appears in the above-identified patent and that said Letters Patent is hereby corrected as shown below:

Title page,
Item [30], Foreign Application Priority Data, please delete the last listed priority document as follows: "Nov. 4, 1999 (JP) . . . . . 11-313555".

Signed and Sealed this

Twenty-second Day of April, 2003

JAMES E. ROGAN
*Director of the United States Patent and Trademark Office*